US008573970B2

(12) United States Patent
Errobidart

(10) Patent No.: US 8,573,970 B2
(45) Date of Patent: Nov. 5, 2013

(54) DENTAL PROSTHESIS FOR BOVINE ANIMALS WITH FULLY OR PARTIALLY WORN DOWN TEETH

(76) Inventor: Osvaldo Rodolfo Errobidart, Provencia de Buenos Aires (AR)

( * ) Notice: Subject to any disclaimer, the term of this patent is extended or adjusted under 35 U.S.C. 154(b) by 0 days.

(21) Appl. No.: 13/391,854

(22) PCT Filed: Aug. 24, 2010

(86) PCT No.: PCT/CL2010/000031

§ 371 (c)(1),
(2), (4) Date: Feb. 23, 2012

(87) PCT Pub. No.: WO2011/022858

PCT Pub. Date: Mar. 3, 2011

(65) Prior Publication Data

US 2012/0156631 A1 Jun. 21, 2012

(30) Foreign Application Priority Data

Aug. 24, 2009 (AR) ..... P090103245

(51) Int. Cl.
*A61D 5/00* (2006.01)

(52) U.S. Cl.
USPC ..... 433/1

(58) Field of Classification Search
USPC ..... 433/1, 167, 172; 119/174; 623/66.1; 600/243–244
See application file for complete search history.

(56) References Cited

U.S. PATENT DOCUMENTS

| | | | | |
|---|---|---|---|---|
| 3,462,838 | A * | 8/1969 | Alstergren | 433/1 |
| 4,302,184 | A * | 11/1981 | Carney | 433/1 |
| 4,412,818 | A * | 11/1983 | Thomson | 433/1 |
| 5,324,198 | A * | 6/1994 | Hazen | 433/171 |
| 6,196,838 | B1 * | 3/2001 | Lukase et al. | 433/1 |

* cited by examiner

*Primary Examiner* — Cris L Rodriguez
*Assistant Examiner* — Matthew Seward
(74) *Attorney, Agent, or Firm* — Greer, Burns & Crain, Ltd.

(57) ABSTRACT

A dental prosthesis for bovine animals with fully or partially worn down teeth. For bovine animals with partially worn down teeth, the prosthesis is a laminar plate of a rigid material, bent forwards, with an upward fold having a sawn edge along its front curve connected to a lower laminate of the same shape and size, from which a tongue projects downwards into the central front zone, at the end of which two small laminates are folded, and in the rear, a tongue projects behind, and divides into two, thereby creating a fold towards the front and encompassing two wires in the transverse direction, the ends of which are housed in the front laminates. For bovine animals with fully worn down teeth, the laminar plates have a downwardly inclined fold along the entire front curve thereof.

5 Claims, 9 Drawing Sheets

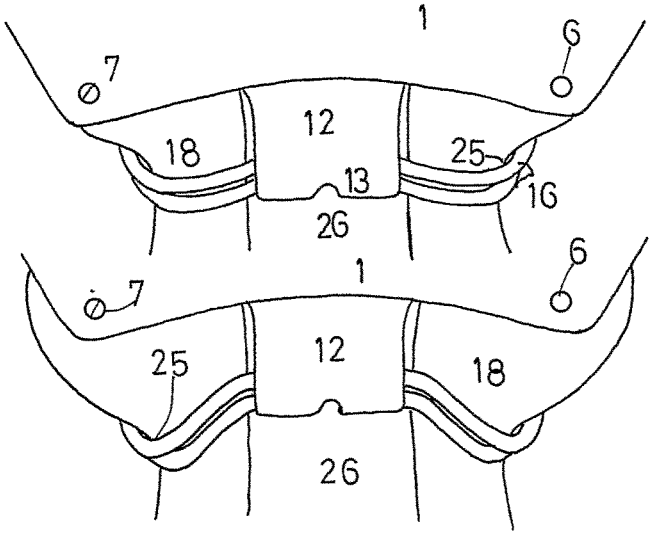
FIG. 22A
FIG. 22B
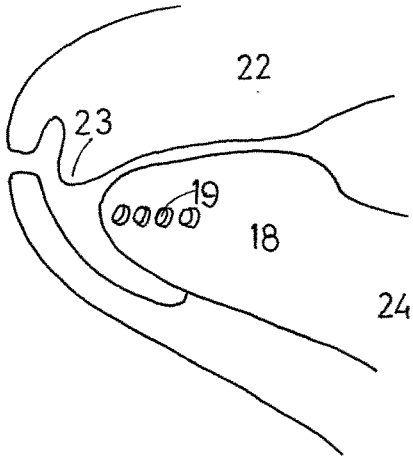
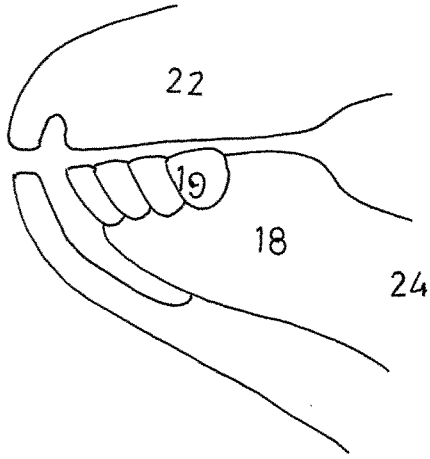
FIG. 23A
FIG. 23B

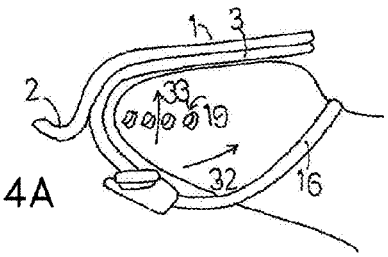
FIG. 24A
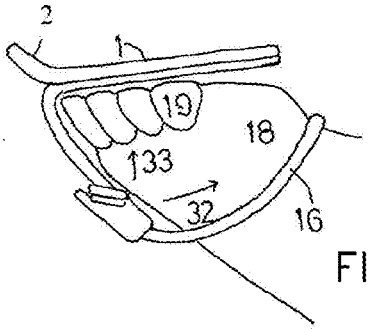
FIG. 24B
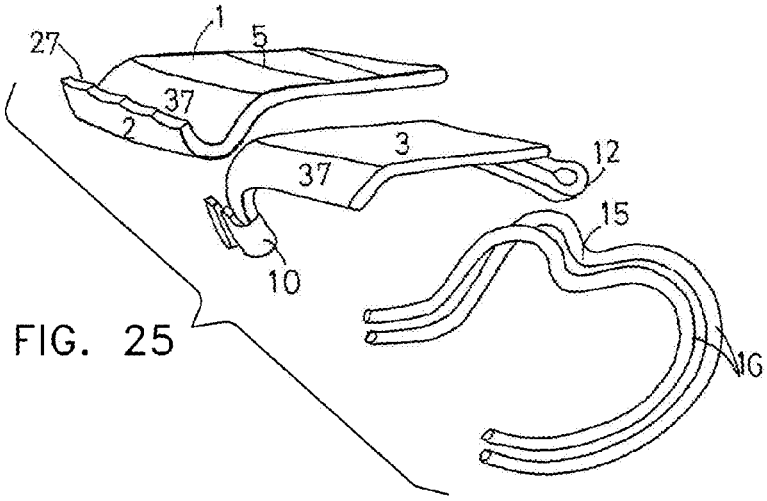
FIG. 25
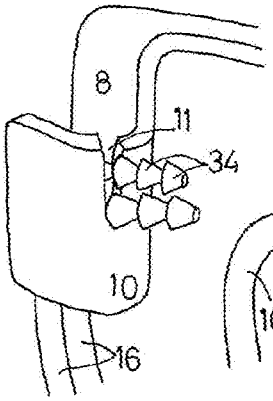
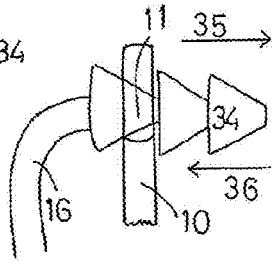
FIG. 26A FIG. 26B

DENTAL PROSTHESIS FOR BOVINE ANIMALS WITH FULLY OR PARTIALLY WORN DOWN TEETH

CROSS-REFERENCE TO RELATED APPLICATION

The present application claims the priority under 35 U.S.C. 119 of Argentine Application No. 20090103245, filed Aug. 24, 2009, which is hereby incorporated herein by reference in its entirety.

BACKGROUND

1. Technical Field

This invention refers to the standard dental prosthesis for bovine animals that brings a solution to the worn down teeth in each and all grades thereof, with mechanical retention in the waist of the lower premaxilla.

2. Prior Art

See Argentine Patents Nos. 020100491 and 050100253 for the art state.

SUMMARY a) The sawn edge (27) allows an easy and quick grass cutting, while at the same time it produces less tension of the device over the premaxilla increasing the animal comfort.

b) The upper nonslip zone (5) prevents the grass from slipping when being pulled up upon being pressed by the upper jaw, and also prevents the prosthesis from being projected forwards at the same time.

c) The extension downwards the front close (8) allows the arms closing in a smaller diameter and further down, where the bone of the premaxilla is stronger and more solid getting away from the lateral wings of the premaxilla (21) which are highly fragile and breaks when a retention arm works in that zone. In FIG. 24, we can appreciate that the close support (8) by being longer it may be housed under the dead angle of the premaxilla (20) preventing the prosthesis from moving in a sense (32) that causes the rear part or the front zone moving upwards, as shown in (33).

d) The lower zone of the lower laminar plate (3) is fully flat because the rear fold that fits behind the incisors has been suppressed; this is so because the efficiency of the arms allows the widening of the standardization and eliminates the pivot produced in the prosthesis caused by this fold which also produced a strong wear down behind the incisors and, in some cases it pushed them forwards when they were loose thereby causing the loss of some pieces.

e) Between the premaxilla (18) and the lower jaw (24) there are different natural inclination angles that are produced by different grades of wearing down of the incisors (19) as shown in FIG. 19, that if they are not properly regulated in the prosthesis of the prior art, a free space (28) appears in the right side, as shown in FIG. 20, between the retainer and the waist of the premaxilla, causing a pivot of the prosthesis in the sense (29) and goes out in the sense (30). The premaxillas also differ in its length, as shown in FIG. 21, thereby the prosthesis of the prior art should be modified by either shortening or lengthening the prosthesis with a tool (31) in order to get adjusted; these operations are complicated and in the prosthesis of the present invention this operation is automatically made by only adjusting the retainers (16).

f) The retainers which are made of fibers may be used in this prosthesis without any modification of the device.

g) The shape for the animals' prosthesis with fully worn down teeth allows the recovery of animals that had no further solution before.

BRIEF DESCRIPTION OF THE DRAWINGS

FIG. 22A shows a portion of a dental prosthesis according to the present invention on a premaxilla of a first size;

FIG. 22B shows the portion of the dental prosthesis of FIG. 22A on a premaxilla of a second size;

FIG. 23A shows a deformity in the upper jaw when the front incisors have been fully worn down;

FIG. 23B shows the upper jaw when the front incisors have not been worn down;

FIG. 24A shows a first shape of a dental prosthesis according to the present invention when the front incisors have been fully worn down;

FIG. 24B shows a second shape of a dental prosthesis according to the present invention when the front incisors have not been fully worn down;

FIG. 25 is an exploded view of a portion of a dental prosthesis according to the present invention;

FIG. 26A is an enlarged view of a portion of the dental prosthesis according to the present invention showing a retainer mechanism; and FIG. 26B is an enlarged view of a portion of FIG. 26A showing the retainer mechanism.

Figure 1:
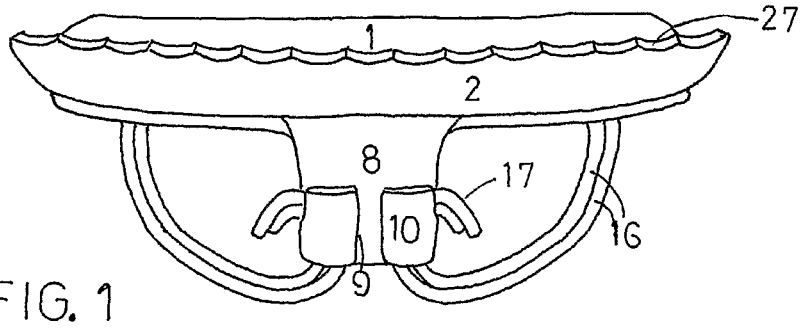
FIG. 1 is a front elevation of a dental prosthesis according to the present invention for bovines with partially worn down teeth.
Figure 2:
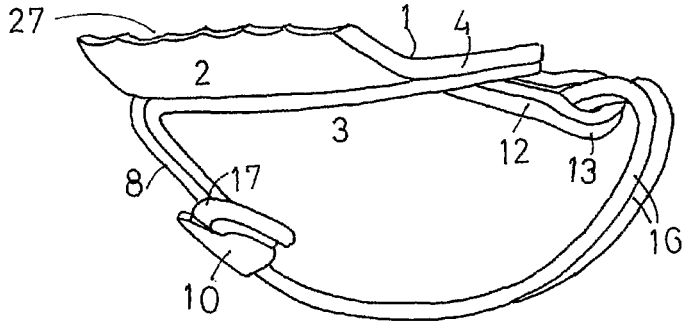
FIG. 2 is a right side elevation of the dental prosthesis of FIG. 1.
Figure 3:
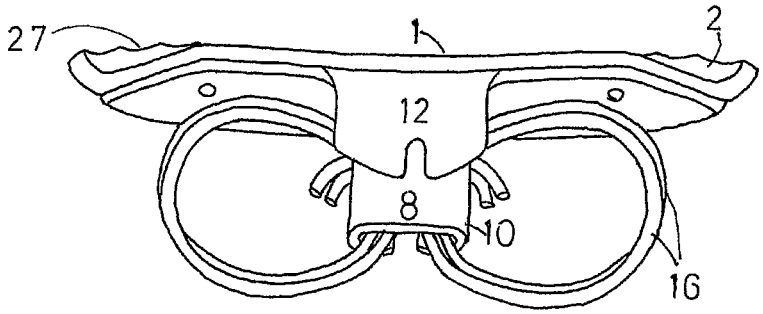
FIG. 3 is a rear elevation of the dental prosthesis of FIG. 1.
Figure 4:
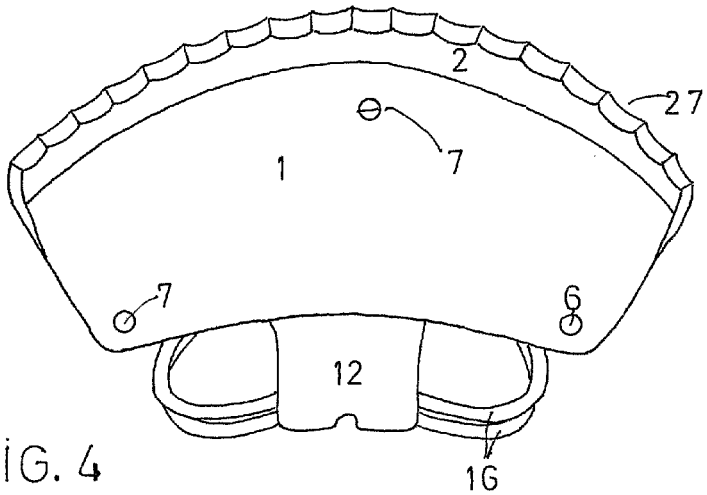
FIG. 4 is a top plan view of the dental prosthesis of FIG. 1.
Figure 5:
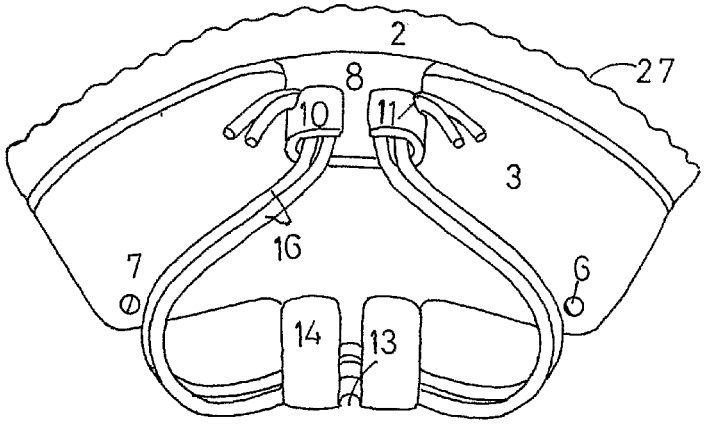
FIG. 5 is a bottom plan view of the dental prosthesis of FIG. 1.

The standard dental prosthesis for bovine animals in its different shapes may be made of metal or other rigid materials.

The prosthesis may be made of stainless steel using the split and stamping technique with matrixes installed in a metallurgical swinging arm, then pieces are joined by pressing the wire helmet, and through ring staples, screws and welding in the case of the upper and lower laminar plates.

DETAILED DESCRIPTION

First, the standard dental prosthesis for bovine animals with partially worn down teeth is described; as shown from different angles in FIGS. 1, 2, 3, 4 and 5 where the upper laminar plate (1) made of rigid and stainless material is found in a horizontal position, curved forwards with slightly convergent side backwards (4), with a fold upwards and forwards (2) with the sawn upper edge (27) in the entire front curvature thereof, with a nonslip surface in the upper zone (5), with drillings (6) to house screws, ring staples, etc. (7), mounted and fixed over the lower laminar body (3) of the same shape and size as the one that projects in the front-central zone, a tongue projects downwards behind (8) in which end two smaller tongues are folded (10) over the front face from each side, facing themselves with the free end thereof (9), with a pocket (11) in the upper part of each fold (10). From the rear and central zone of the lower laminar plate (3) a tongue is projected behind with a slight inclination downwards, which is referred to as retainers (12), whose end divides into two (13) and produces a fold over itself forwards where it is fixed in the ends thereof by welding, screws, etc. (14), encompassing two wires of stainless steel of the aisi 316 soft type, in the transverse direction, with a diameter of approximately 1.75 mm. (16), and after a small curve of retention (15), a pair goes out through each side and enters into through the lower part of the close laminates (10), going out through each pocket (11), where they are fixed by a fold downwards (17).

Figure 6:
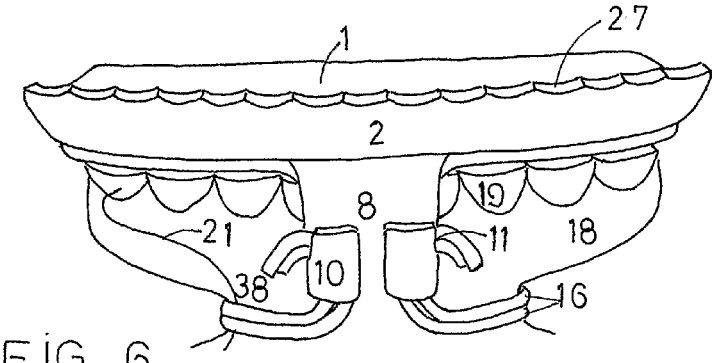
FIG. 6 is a front elevation of the dental prosthesis of FIG. 1 on a premaxilla of a bovine animal.
Figure 7:
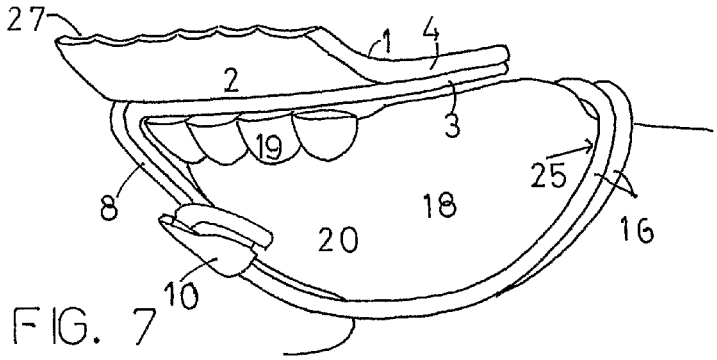
FIG. 7 is a right side elevation of the prosthesis of FIG. 1 on a premaxilla of a bovine animal.

FIGS. 6, 7, 8, 9 and 10 show the prosthesis placed on a premaxilla (18) with primary worn down incisor teeth (19), being possible to appreciate how the prosthesis covers the group of premaxilla and the teeth, stopping the dental worn down and increasing the teeth length, FIG. 6 point (2). In (8) it can be seen how the close support is projected into the mentalis zone of the premaxilla (20), where the bone forms a highly retained dead angle as shown in FIG. 7. In FIG. 6 point (21) the bone of the premaxilla in the form of a wing (21) is shown, very weak with much soft tissue surrounding thereto; when the retainers work in this zone, the bone is broken in the form of a wing (21) and the prosthesis goes out, however by reaching the lower waist of the premaxilla (38) where the bone is solid, the maximum retention is obtained.

Figure 8:
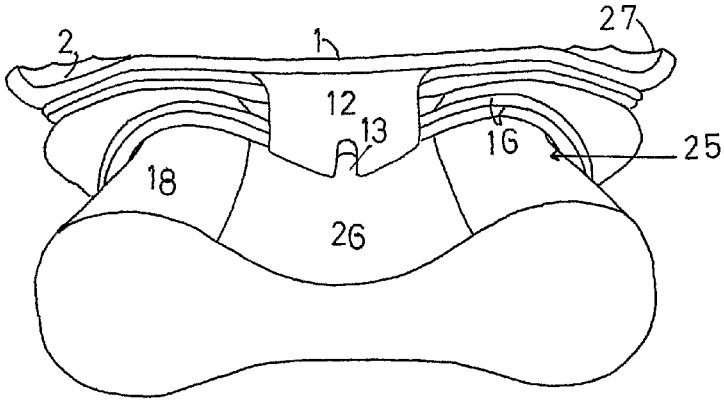
FIG. 8 is a rear elevation of the dental prosthesis of FIG. 1 on a premaxilla of a bovine animal.

In FIG. 8 the prosthesis mounted on the premaxilla (18) is shown as from behind, where the point (12) shows how the retainers support goes down over the lingual channel (26). This retainers support disposed in the centre with a strong structure allows the automatic adjustment of the retainers (16) to the waist of the premaxilla independently of the inclination grade of the premaxilla with respect to the jaw, to the worn down incisors, to the waist diameter, just tightening to the front close (10).

Figure 9:
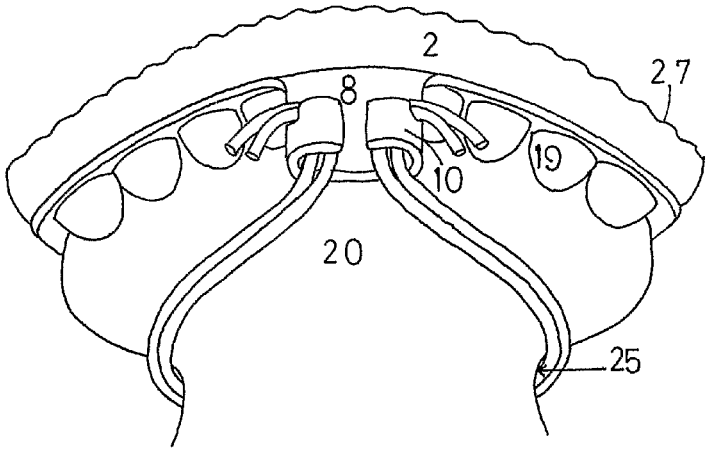
FIG. 9 is a perspective view from the front and bottom of the dental prosthesis of FIG. 1 on a premaxilla of a bovine animal.

FIG. 9 shows, from downwards, the rear waist of the premaxilla (25) where the retainers are fixed (16) that by being double bring the following advantages:

a) Support the fatigue of millions of annual cuttings b) Each of them is of a little thickness, the lower anatomy of the premaxilla, which would be impossible to do with only one wire of 3 mm diameter in a so small space due to the resistance of the wire when being bended.

c) The double disposition in a vertical way occupies a minimum space in the front close (10), preventing the grass accumulation.

d) If a retainer is cut, the prosthesis continues working without problems.

Figure 10:
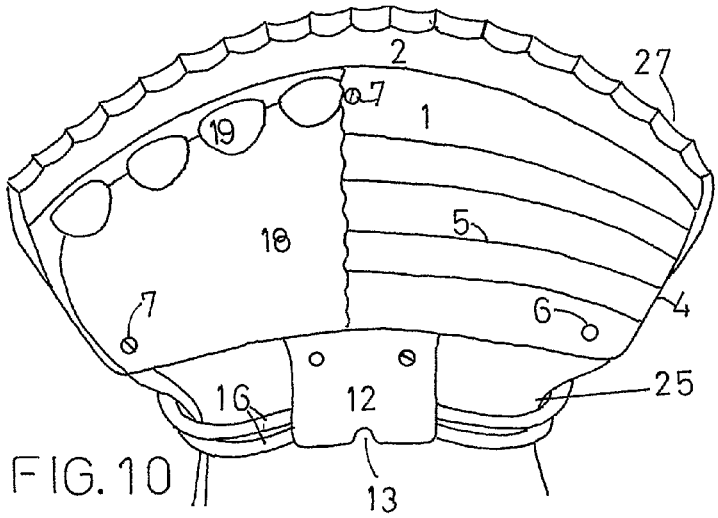
FIG. 10 is another view of the dental prosthesis of FIG. 1 on a premaxilla of a bovine animal.
Figure 11:
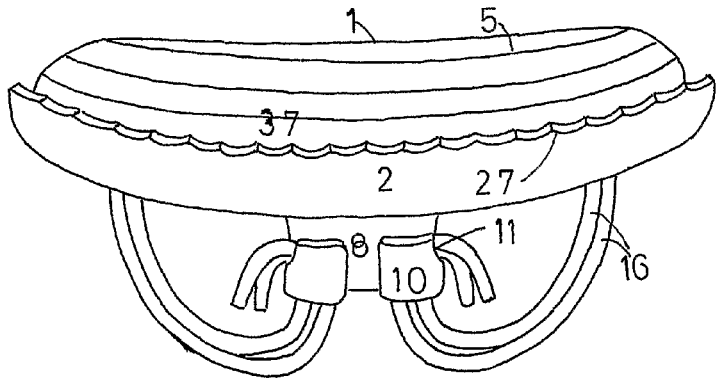
FIG. 11 is a front elevation of a dental prosthesis for bovines with fully worn down teeth.
Figure 12:
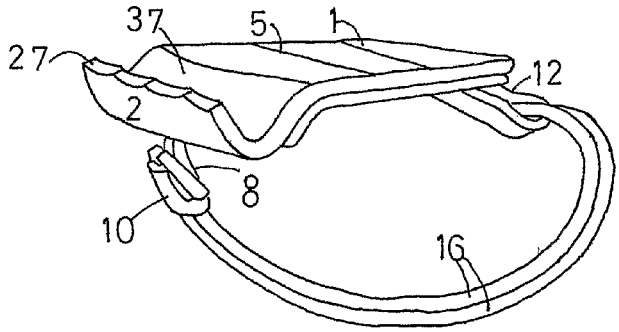
FIG. 12 is a perspective view taken from the front, top and right side of the dental prosthesis of FIG. 11.
Figure 13:
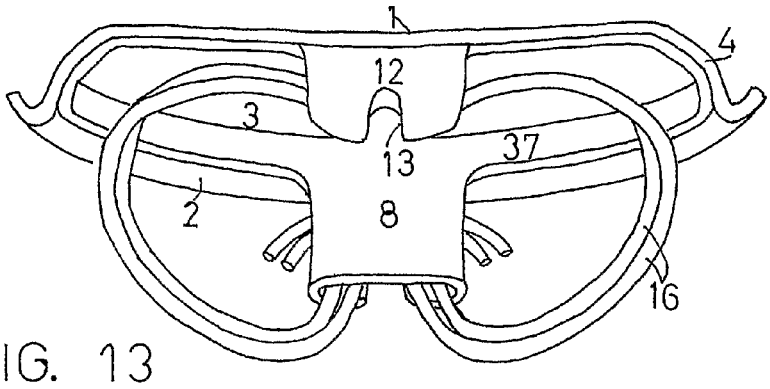
FIG. 13 is a perspective view taken from the rear and bottom of the dental prosthesis of FIG. 11.
Figure 14:
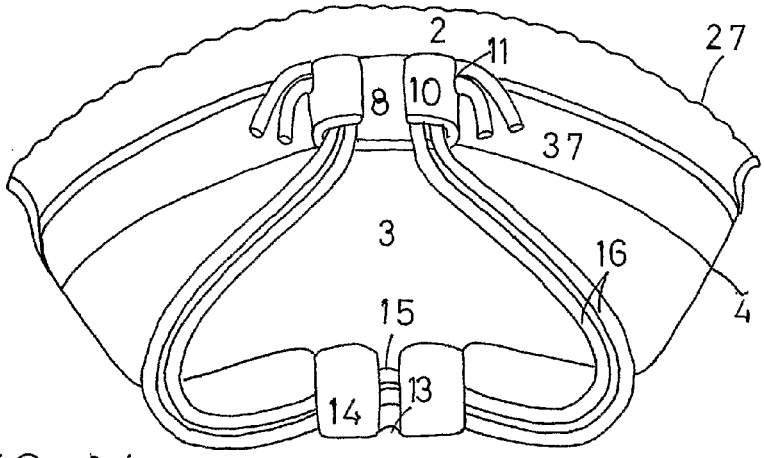
FIG. 14 is a perspective view taken from the front and bottom of the dental prosthesis of FIG. 11.
Figure 15:
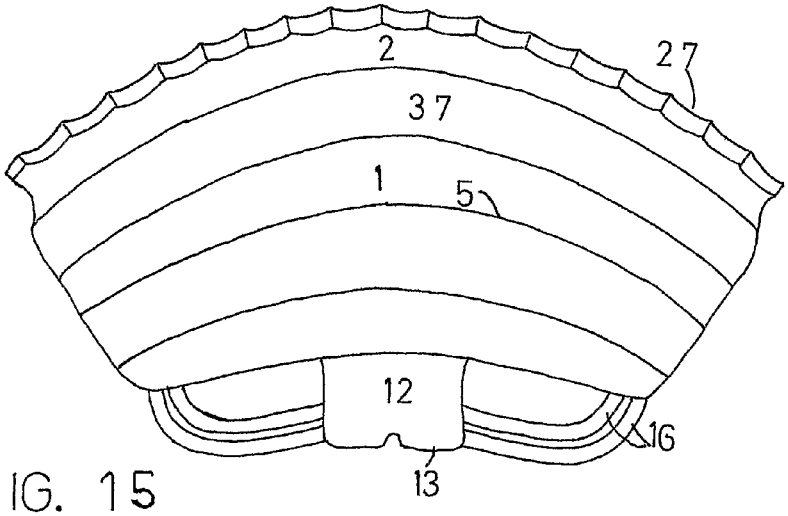
FIG. 15 is a top plan view of the dental prosthesis of FIG. 11.

In FIG. 10, how the prosthesis protects the teeth (19) and the soft tissues of the premaxilla (18) in the transparent split zone can be appreciated.

In FIGS. 11, 12, 13, 14 and 15 the standard dental prosthesis for bovines with fully worn down teeth from different positions is shown, being different from the prosthesis for bovines with partially worn down teeth in the fact that in the front curvature both laminar plates are slightly projected downwards (37) before making the front upward fold (2).

Figure 16:
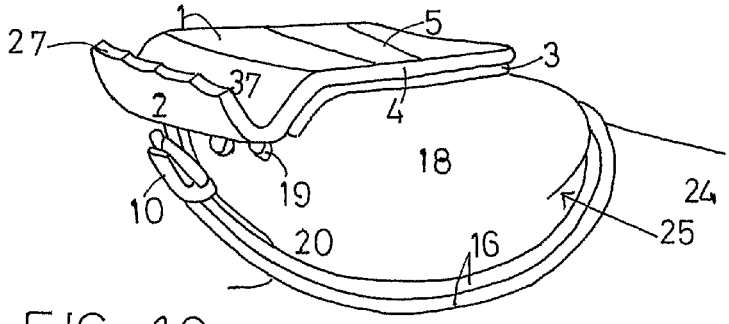
FIG. 16 is a perspective view from the front top and right side of the dental prosthesis of FIG. 11 on a premaxilla of a bovine animal with fully worn down teeth.
Figure 17:
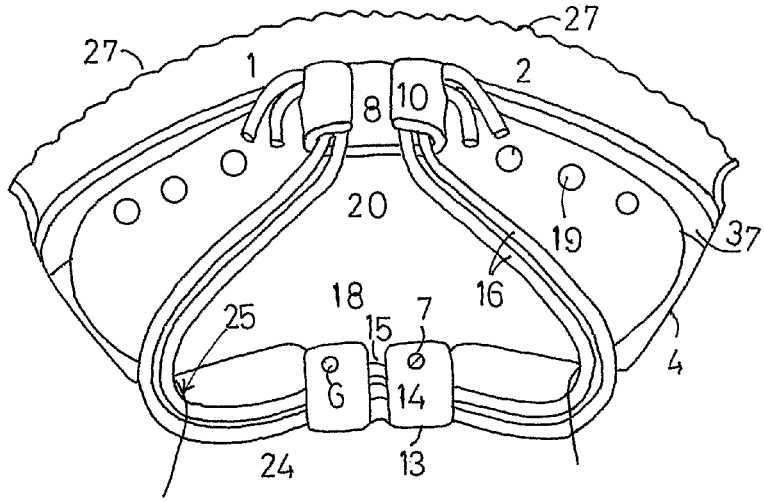
FIG. 17 is a perspective view taken from the front and bottom of the dental prosthesis of FIG. 11 on the premaxilla of a bovine animal with fully worn down teeth.
Figure 18:
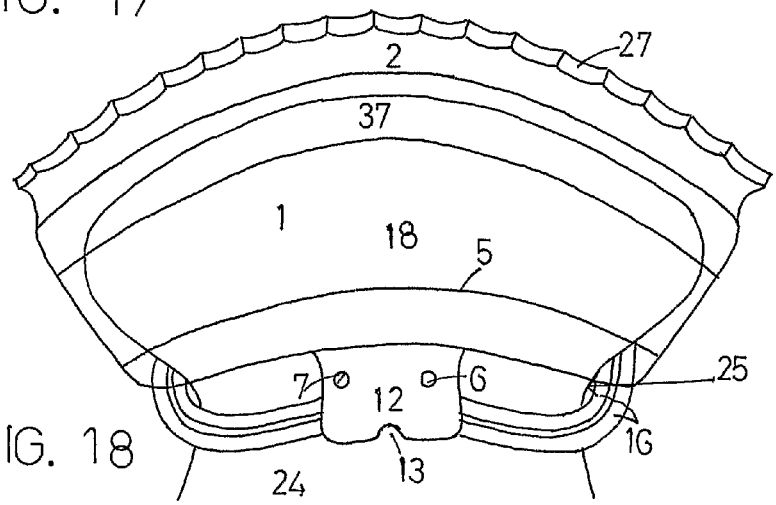
FIG. 18 is a top plan view of the dental prosthesis of FIG. 11 on a premaxilla of a bovine animal with fully worn down teeth.
Figure 19A:
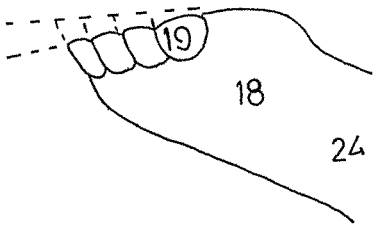
FIG. 19A shows a first angle of a premaxilla of a bovine animal.
Figure 19B:
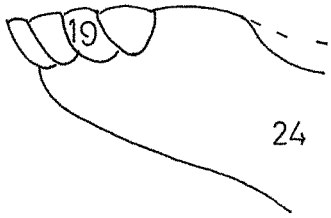
FIG. 19B shows a second angle of a premaxilla of a bovine animal.

In FIGS. 16, 17 and 18 the same prosthesis is shown, mounted over a premaxilla of a fully toothless bovine animal where the different elements previously described are appreciated, the front close (10), the retainers (16), the upper laminar plate (1) and the lower laminar plate (3).

FIG. 23 shows at the right side, how both upper (22) and lower (18) jaws put into contact, when the natural teeth (10) have little wearing down and the upper jaw seats over the teeth in a flat way, that's why a flat laminar plate (1) is used in these cases, right FIG. 24 and to the left it is shown how both jaws (22) and (19) put into contact, when the front incisors (19) have been fully worn down, where in order to compensate the lack of incisors, the soft tissues of the front zone of the upper jaw (23) have been projected downwards, that's why the prosthesis being placed in these cases should present a downward curvature in the front zone (37) in FIG. 24.

FIG. 25 shows the prosthesis disassembling into three main elements thereof, the upper laminar plate (1), the lower laminar plate (3) and the wire retainers (16).

FIG. 26 shows the retainers made of carbon fibers, whose ends at the front close zone (8) have the form of successive cones (34) that block the pocket (11) of the plate (10) in the sense of (35) and the base of the cone by being bigger than the pocket (11) cannot return in the sense (36), being the retainer adjusted as those of wire.

Figure 20A:
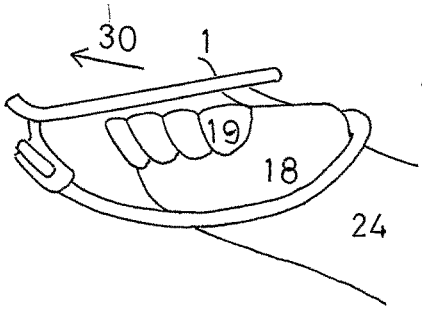
FIG. 20A (Prior Art)
FIG. 20A shows a first position of a prior art device relative to a premaxilla of a bovine animal.
Figure 20B:
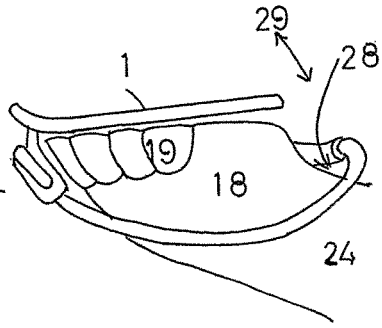
FIG. 20B (Prior Art)
FIG. 20B shows a second position of a prior art device relative to the premaxilla of a bovine animal.
Figure 21A:
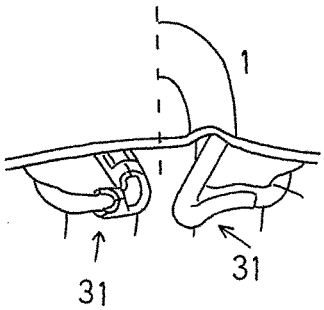
FIG. 21A (Prior Art)
FIG. 21A shows a prior art device on a premaxilla of a first length.
Figure 21B:
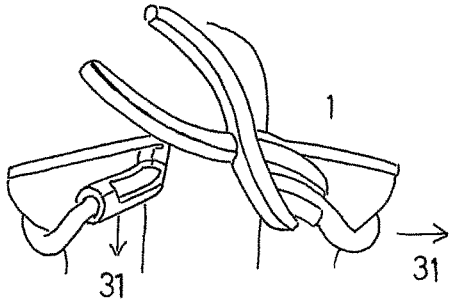
FIG. 21B (Prior Art)
FIG. 21B shows the prior art device of FIG. 21A on a premaxilla of a second length.

(1) upper laminar plate
(2) upward folds
(3) lower laminar
(4) plate side
(5) nonslip surface
(6) drillings, screws
(7) ring staples, screws
(8) front tongue of the lower plate
(9) free ends of the front close
(10) close tongues
(11) pockets
(12) retainers support
(13) division of rear tongues
(14) fold retainers support (15) retention curve
(16) retainers
(17) retainers folds
(18) lower premaxilla
(19) natural incisors
(20) mentalis zone of the premaxilla
(21) wing bone of the premaxilla
(22) upper jaw
(23) front deformed upper jaw
(24) lower jaw
(25) rear waist of lower premaxilla
(26) lingual channel
(27) sawn edge
(28) space between arm and waist of the premaxilla
(29) movement FIG. 20
(30) movement FIG. 20
(31) movement FIG. 21
(32) movement FIG. 24
(33) movement FIG. 24
(34) close cones
(35) adjustment sense FIG. 26
(36) block sense FIG. 26
(37) front curved folds

The invention claimed is:

1. A dental prosthesis for bovine animals with worn down teeth, comprising:

a first laminar plate having a front curving horizontally and sides converging toward one another from the front to a rear of the first laminar plate, the first laminar plate being made of rigid, stainless material, with a nonslip upper surface, with the entire front having an upward and forward fold that presents a sawn edge, the first laminar plate being fixed over a second laminar plate having a front central zone from which a first tongue projects downward with a rearward inclination, second and third tongues, each smaller than the first tongue, extending in folds from opposite sides of the first tongue and terminating in ends facing one another in front of a front face of the first tongue, a recess being defined in an upper surface of each of the folds and, from a rear portion of the second laminar plate, a fourth tongue projecting rearward and downward and dividing into two fixed fold portions extending forward from a main portion of the fourth tongue with two retainers extending through an interior of the two fixed fold portions and forward through the folds of the second and third tongues and the recesses in the upper surfaces of the folds of the second and third tongues, where the retainers are fixed, whereby an interior cavity capable of housing a premaxilla of a bovine animal with worn down teeth is defined.

2. A dental prosthesis for bovine animals with worn down teeth according to claim 1, wherein the front of the first laminar plate has a first fold bending downward and a second fold bending upward from the first fold along the entire front of the first laminar plate, and the second laminar plate having a downward fold congruent to the first fold of the first laminar plate.

3. A dental prosthesis for bovine animals with worn down teeth according to claim 1, wherein the retainer comprise reinforcement fibers, and a plurality of successive cones, one after the other, the cones being selectively positionable in one of the recesses and engageable with one of the folds of the second and third tongues.

4. A dental prosthesis for bovine animals with worn down teeth according to claim 2, wherein the retainers comprise reinforcement fibers, and a plurality of successive cones, one after the other, the cones being selectively positionable in one of the recesses and engageable with one of the folds of the second and third tongues.

5. A dental prosthesis for bovine animals with worn down teeth according to claim 1, wherein the retainers comprise stainless wires.

* * * * *